US011725893B2

(12) United States Patent
Yu

(10) Patent No.: US 11,725,893 B2
(45) Date of Patent: Aug. 15, 2023

(54) COMPACT AMMUNITION CONVEYOR TWISTER

(71) Applicant: Meggitt Defense Systems, Inc., Irvine, CA (US)

(72) Inventor: Dino Yu, Irvine, CA (US)

(73) Assignee: Meggitt Defense Systems, Inc., Irvine, CA (US)

( * ) Notice: Subject to any disclaimer, the term of this patent is extended or adjusted under 35 U.S.C. 154(b) by 0 days.

(21) Appl. No.: 17/659,802

(22) Filed: Apr. 19, 2022

(65) Prior Publication Data

US 2022/0357119 A1 Nov. 10, 2022

Related U.S. Application Data

(60) Provisional application No. 63/196,500, filed on Jun. 3, 2021, provisional application No. 63/184,393, filed on May 5, 2021.

(51) Int. Cl.
*F41A 9/03* (2006.01)

(52) U.S. Cl.
CPC ..... *F41A 9/03* (2013.01)

(58) Field of Classification Search
CPC ..... F41A 9/01; F41A 9/03; F41A 9/04
USPC ..... 89/33.01, 33.14, 33.16, 33.17, 33.2, 89/33.25, 35.01
See application file for complete search history.

(56) References Cited

U.S. PATENT DOCUMENTS 737,216 A 8/1903 Forry
2,379,185 A 6/1945 Reek
2,390,331 A * 12/1945 Sanford ..... F42B 39/08 89/35.01
2,915,947 A * 12/1959 Heeley ..... F42B 39/08 89/35.01
3,031,934 A * 5/1962 Clark ..... F42B 39/08 89/35.01
3,670,863 A * 6/1972 Meier ..... F41A 9/04 89/33.03
3,704,772 A * 12/1972 Meier ..... F41A 9/02 414/217

(Continued)

FOREIGN PATENT DOCUMENTS

WO WO-2005031243 A1 * 4/2005 ..... F41A 9/02

OTHER PUBLICATIONS

Machine translation of WO 2005/031243, Aug. 22, 2004, 7 pages. (Year: 2004).*

(Continued)

*Primary Examiner* — Bret Hayes
(74) *Attorney, Agent, or Firm* — Stetina Brunda Garred and Brucker

(57) ABSTRACT

A conveyor mechanism for use with ammunition rounds includes a plurality of clamshells pivotally interconnected to each other, with each clamshell including a first body and a second body pivotally connected to the first body. Each clamshell is selectively transitional between an ammunition holding configuration and an ammunition release position, with the second body pivoting relative to the first body to facilitate transition between the ammunition holding configuration and the ammunition release configuration. The first and second bodies are configured to cooperatively engage one of the ammunition rounds when the clamshell is in the ammunition holding configuration.

16 Claims, 11 Drawing Sheets

(56) References Cited

U.S. PATENT DOCUMENTS

| | | | | | |
|---|---|---|---|---|---|
| 4,434,699 | A | | 3/1984 | Tassie | |
| 4,474,102 | A | * | 10/1984 | Tassie | F42B 39/08 89/33.17 |
| 4,492,144 | A | | 1/1985 | Dix | |
| 4,939,978 | A | * | 7/1990 | Bishop | F41A 9/57 89/33.14 |
| 5,151,556 | A | * | 9/1992 | Maher | F41A 9/76 198/803.15 |

OTHER PUBLICATIONS

Patent Cooperation Treaty, International Search Report and Written Opinion for International Application No. PCT/US2022/026164, dated Nov. 21, 2022, 9 pages.

* cited by examiner

COMPACT AMMUNITION CONVEYOR TWISTER

CROSS-REFERENCE TO RELATED APPLICATIONS

This application claims the benefit of U.S. Provisional Application No. 63/184,393, filed May 5, 2021, and U.S. Provisional Application No. 63/196,500, filed Jun. 3, 2021, the contents of which are expressly incorporated herein by reference.

STATEMENT RE: FEDERALLY SPONSORED RESEARCH/DEVELOPMENT

Not Applicable

BACKGROUND

1. Technical Field

The present disclosure relates generally to an ammunition conveyance system and method, and more particularly, to an ammunition conveyance system and method adapted to transport ammunition rounds between an ammunition magazine and a gun via a twisting action.

2. Description of the Related Art

Historically, ammunition conveyance between a gun and a magazine has been accomplished via each ammunition round being carried by individual conveyors that cradle and transport the ammunition. These conveyors or links typically move inside flexible chutes, which provide structural support and guidance for the conveyors and also provide control of the ammunition between the two ends points of travel.

A common disadvantage associated with this typical conveyance method is that it is limited in the amount that it can twist without jamming. To support a gun elevation range of over 90 degrees usually requires a relatively long distance between the two end points; thus, the structure that encloses the two end points is large and the turret must be enlarged to contain it. Turret size is very undesirable because it both makes for a larger target and it increases armor weight which makes the vehicle difficult to transport.

In view of the foregoing, there is a need for a compact apparatus and related method of twisting conveyed ammunition. Various aspects of the present disclosure address this particular need, as will be discussed in more detail below.

BRIEF SUMMARY

In accordance with one embodiment of the present disclosure, there is provided a conveyor mechanism for use with ammunition rounds. The conveyor mechanism includes a plurality of clamshells pivotally interconnected to each other, with each clamshell including a first body and a second body pivotally connected to the first body. Each clamshell is selectively transitional between an ammunition holding configuration and an ammunition release position, with the second body pivoting relative to the first body to facilitate transition between the ammunition holding configuration and the ammunition release configuration. The first and second bodies are configured to cooperatively engage one of the ammunition rounds when the clamshell is in the ammunition holding configuration.

Each of the first and second bodies may include a longitudinal wall having an inner edge and an outer edge. The first and second bodies may be pivotally connected adjacent their respective inner edges. The clamshell may be configured such that the outer edges move away from each other as the claim shell transitions from the ammunition holding configuration toward the ammunition release configuration.

Each clamshell may include a shaft, with the first and second bodies of the corresponding clamshell being pivotally connected via the shaft. Each of the first and second bodies may include at least one attachment journal configured to facilitate attachment to the shaft. The shaft may define a pivot axis about which the first body pivots relative to the second body.

Each of the first and second bodies may include a longitudinal wall and a pair of end walls. An adjacent pair of the plurality of clamshells may be pivotally connected to each other at an approximate midpoint between the pair of end walls in each of interconnected clamshells. The plurality of clamshells may be interconnected to each other to define an enclosed loop. The conveyor mechanism may additionally include a pair of rotors in spaced relation to each other, with each rotor being coupled to the enclosed loop.

Each clamshell and rotor may be configured such that travel of each clamshell over one of the pair of rotors causes the clamshell to transition between the ammunition holding configuration and the ammunition release configuration.

The conveyor mechanism may include a central spine or tube interconnecting the pair of rotors and maintaining their separation distance and located in a center region and extending parallel to each of the legs of the conveyor loop. The central spine or tube may define a central axis that is the same twist axis as each of the clamshells interlocking features twist axis and has the freedom to twist about that axis. Upon installation, the separation distance between the pair of rotors may not change independent of the rotation of twist about the central axis.

In one embodiment, the central spine may include multiple extended guide structures that are attached with flexible guide wires.

Each clamshell may be configured to capture a given ammunition round by having a portion of the clamshell being received within an extractor groove in one of the ammunition rounds to facilitate engagement between the clamshell and the ammunition round.

Each clamshell may include a guiding surface configured to interface with an ammunition round for guiding the ammunition round into engagement with the clamshell.

At least one clamshell may be connected to at least one roller to facilitate movement of the at least one clamshell.

The conveyor mechanism may additionally include least one flexible guide wire operatively engaged with the at least one roller.

Adjacent ones of the plurality of clamshells may be pivotable relative to each other about an axis of twist not centered on the clamshells but offset to a projected point at approximately the center of the spine.

The conveyor mechanism may additionally include extended guides having interlocking features that limits the axial twist from one guide to the next.

The conveyor mechanism may further include an external tubular housing sized to receive the plurality of clamshells to provide structural support and also prevent foreign object from getting into the path of the moving conveyor.

The pivot or hinge point of the clamshell conveyor may be moved off axis from an ammunition round centerline and closer to the twist axis. The tube may be used to separate the two rotors instead of a spine. The tube may include at least one joint that allows twist of one rotor relative to the other and may be configured to facilitate shimming or adjusting its length to allow for proper tensioning of the clamshell loop.

Inner facing walls of the clamshells may have a feature that cradles the central tube thereby allowing the tube to provide guidance and support to the clamshells. The feature may include a cam extension configured to engage a similar feature on the opposite side of the loop should the clamshells twist in a manner to contact each other. The cam feature may be configured to contact prior to the ammunition rounds or other clamshell features and the cams would be shaped to slide past each other without jamming.

The hinged clamshells may be connected to each other with a joint that allows twist about a projected point at the tube axis centerline. This may be achieved by a semi-circular track in the clamshell's outward wall that engages the next adjacent clamshell. The engagement method may have stops that limit the twist between clamshells. The engagement method may include springs that resist twisting between clamshells to evenly distribute twist across the clamshell chain.

The present disclosure will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

The detailed description set forth below in connection with the appended drawings is intended as a description of certain embodiments of an ammunition conveying mechanism and is not intended to represent the only forms that may be developed or utilized. The description sets forth the various structure and/or functions in connection with the illustrated embodiments, but it is to be understood, however, that the same or equivalent structure and/or functions may be accomplished by different embodiments that are also intended to be encompassed within the scope of the present disclosure. It is further understood that the use of relational terms such as first and second, and the like are used solely to distinguish one entity from another without necessarily requiring or implying any actual such relationship or order between such entities.

Figure 1:
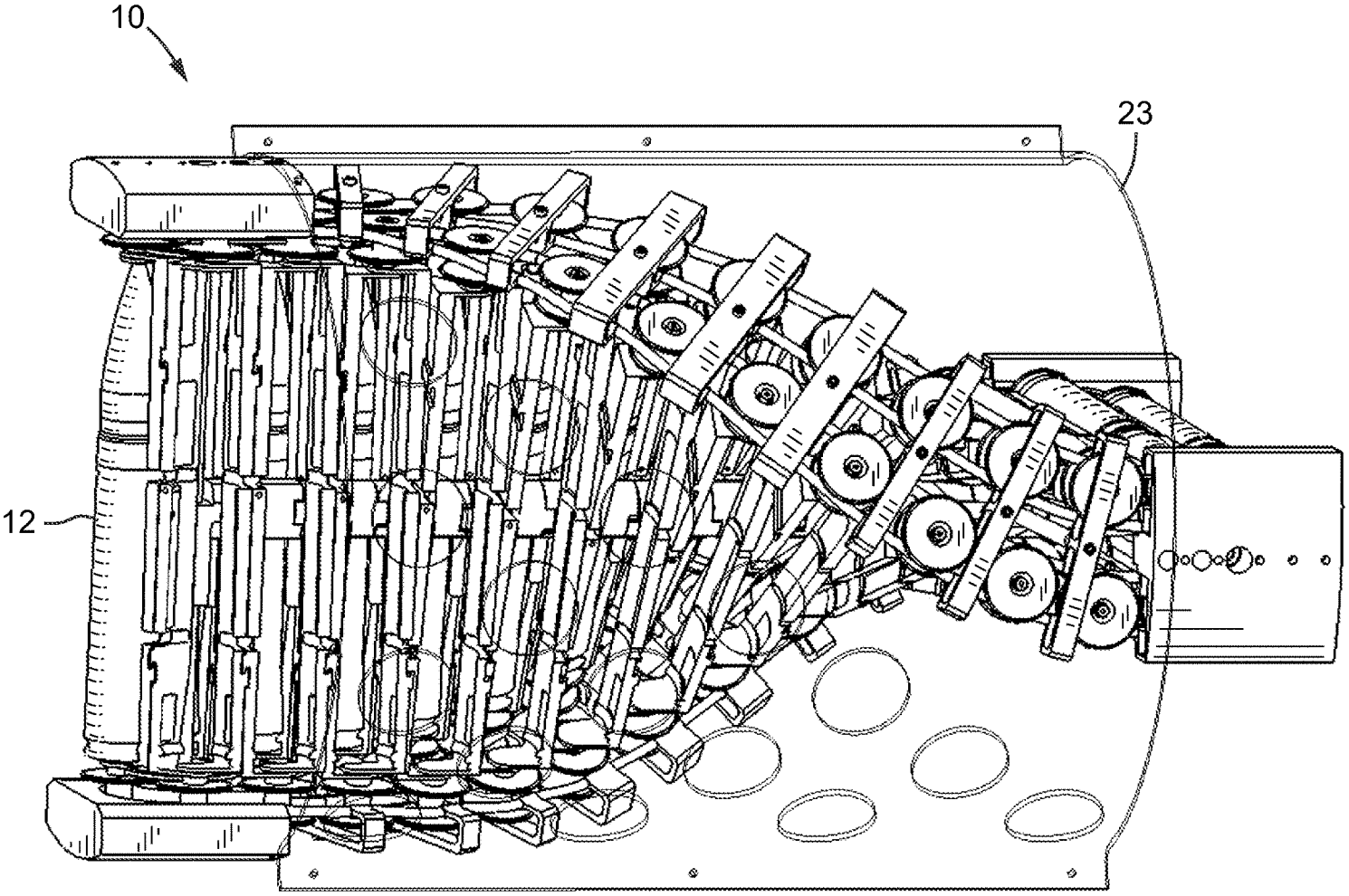
FIG. 1 is a perspective view of a first embodiment a compact conveyor twister for ammunition conveyance.
Figure 1A:
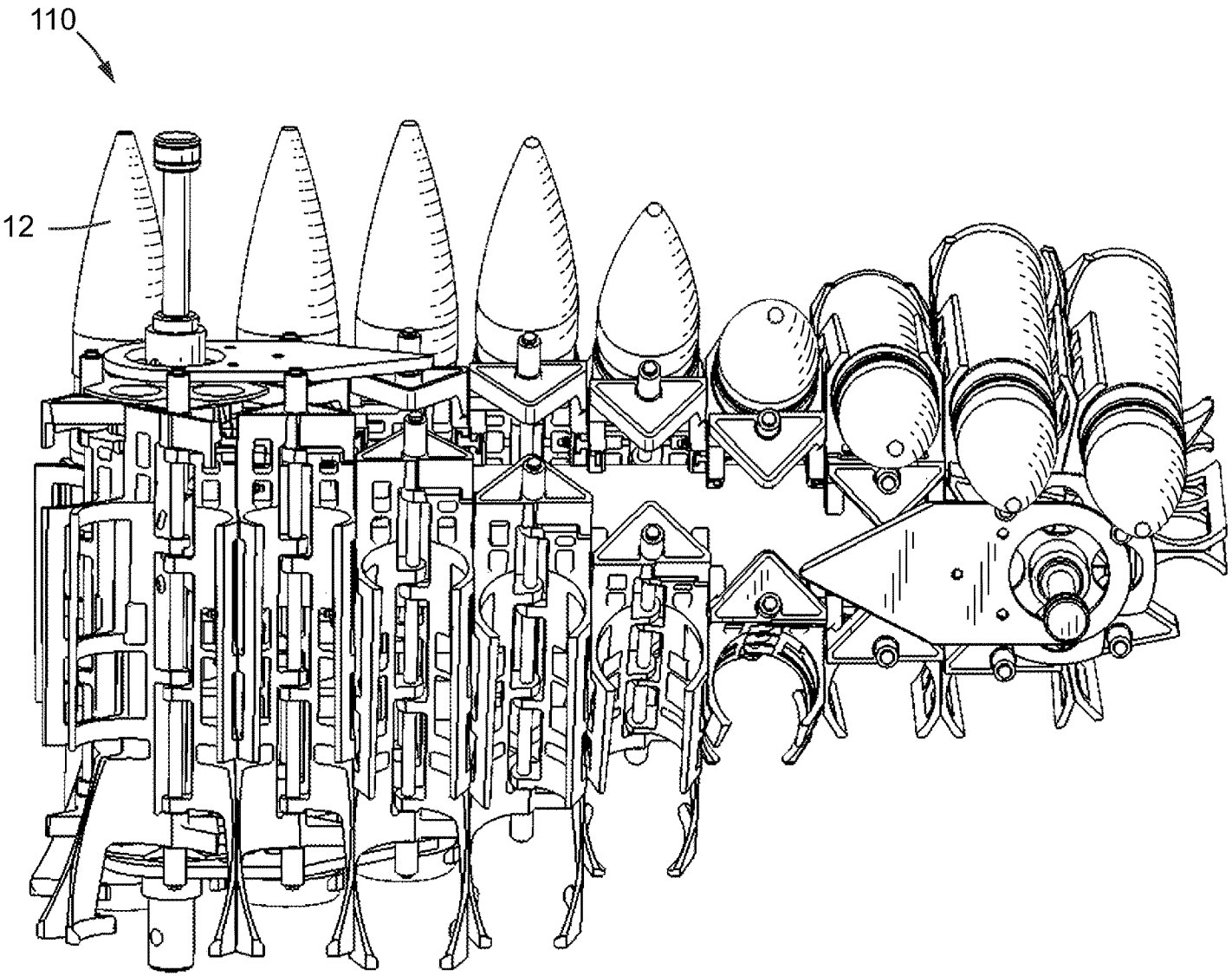
FIG. 1A is a perspective view of a second embodiment of a compact conveyor twister for ammunition conveyance.

Various aspects of the present disclosure pertain to an ammunition conveyance mechanism which may be referred to as a compact conveyor twister. As will be explained in more detail below, the ammunition conveyance mechanisms may be configured for transporting ammunition between an ammunition magazine and a gun. An overall view of a typical installation of a first embodiment of an ammunition conveyance mechanism 10 is depicted in FIG. 1, while FIG. 1A depicts a typical installation of a second embodiment of an ammunition conveyance mechanism 110.

Figure 2:
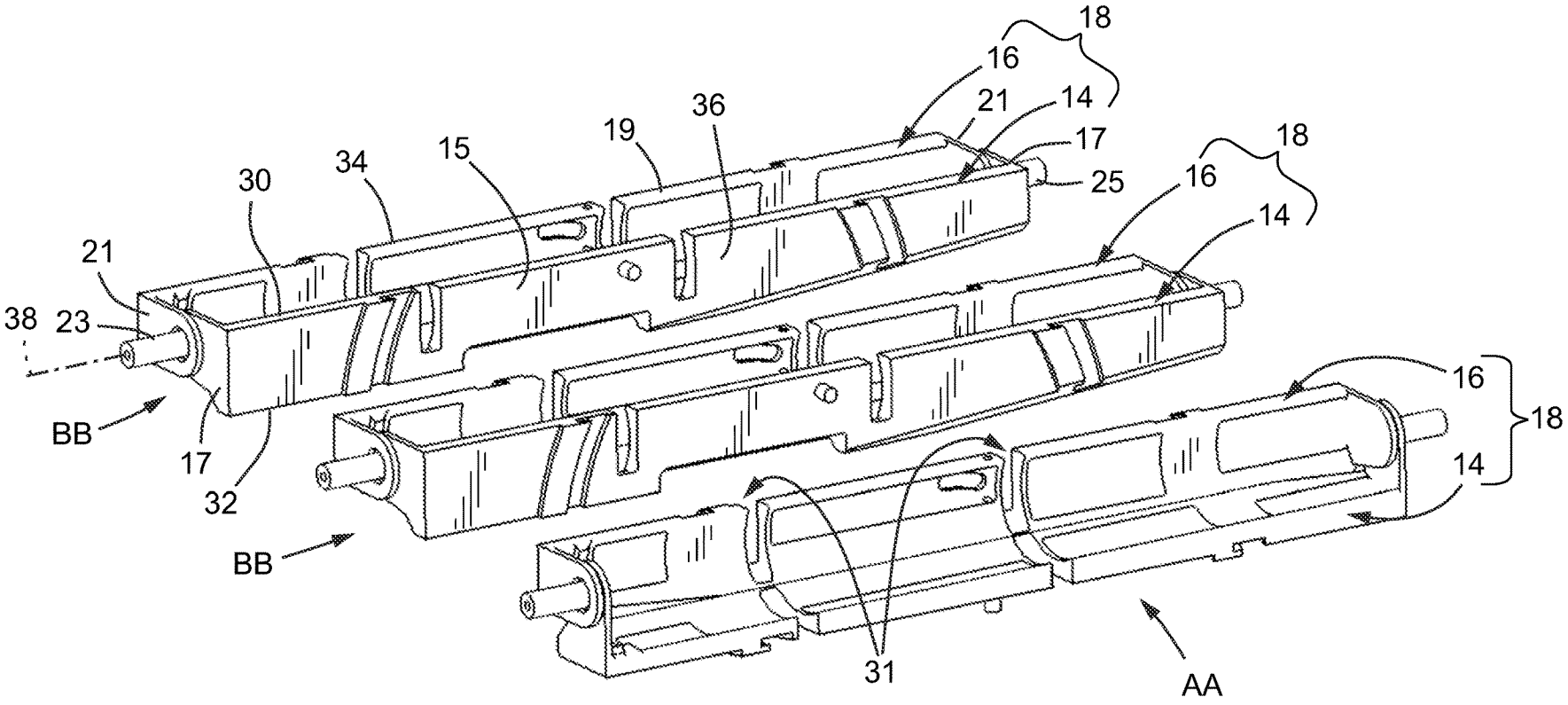
FIG. 2 is an upper perspective view of the first embodiment, depicting a pair of clamshells in round captured configuration, and another clamshell in a round release position.

With regard to the first embodiment of the ammunition conveyance mechanism 10, and referring now specifically to FIG. 2, each ammunition round 12 may be transported via two cooperating parts, i.e., a first part/body 14 and a second part/body 16, that may be configured to selectively capture the round 12. The first body 14 includes a longitudinal wall 15 extending between a pair of opposed end walls 17. The longitudinal wall 15 includes a first longitudinal side 30 and an opposing second longitudinal side 32, both of which extend between the opposed end walls 17.

The second body 16 may be similarly configured and includes a longitudinal wall 19 extending between a pair of opposed end walls 21. The longitudinal wall 19 may include a first longitudinal side 34 and an opposing second longitudinal side 36, both of which extend between the opposed end walls 21.

The first body 14 and second body 16 may be connected to each other in a manner which allows for pivotal movement of the first body 14 relative to the second body 16, such that the movement of the first and second bodies 14, 16 may be similar to a clamshell (the two parts 14, 16 may collectively be referred to as a clamshell 18 herein). According to one embodiment, such pivotal movement is facilitated by a shaft 23 extending from an end wall 17 of the first body 14, which passes through a corresponding aperture formed in an end wall 21 of the second body 16. Similarly, the second body 16 includes a shaft 25 extending from an end wall 21 thereof, and passing through a corresponding aperture formed in an end wall 17 of the first body 14. The arrangement of the shafts 23, 25 and the corresponding apertures may facilitate the articulation of the clamshell 18, while also providing a mounting structure for one or more rollers, as will be described in more detail below. With regard to the articulation of the clamshell 18, the shafts 23, 25 may be coaxially aligned along a pivot axis 38, which may pass through planes defined by the end walls 17, 23, and may be perpendicular to such planes, i.e., the pivot axis 38 may be parallel to the shafts 23, 25, and perpendicular to the end walls 17, 23. Due to the configuration of the clamshell 18, the longitudinal walls 15, 19 may pivot about the pivot axis 38 in a manner where the longitudinal walls 15, 19 remain spaced from the pivot axis 38 by a pivot radius.

According to one embodiment, the first and second bodies 14, 16 may articulate between an ammunition release configuration and an ammunition capture configuration. FIG. 2 shows a pair of clamshells 18 in an ammunition capture configuration represented by BB and a single clamshell 18 in the ammunition release configuration represented by AA. The clamshell 18 may transition between the ammunition release configuration and the ammunition capture configuration to facilitate capture, retainment, and release of ammunition relative to the clamshell 18.

Figure 2A:
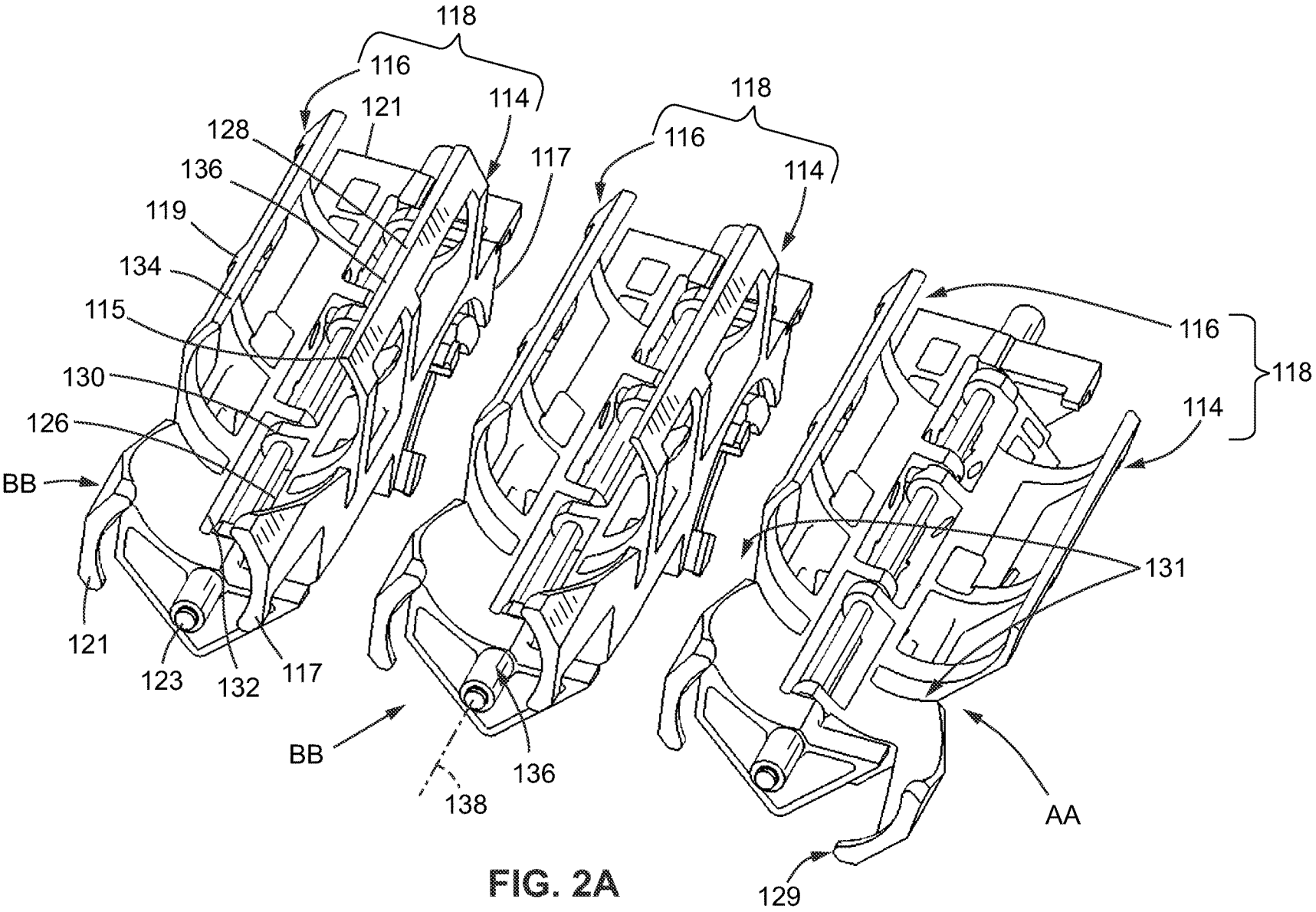
FIG. 2A is an upper perspective view of the second embodiment, depicting a pair of clamshells in round captured configuration, and another clamshell in a round release position.

The second embodiment 110 includes a similar structure to the first embodiment 10, and referring now specifically to FIG. 2A, the second embodiment 110 may include first part/body 114 and second part/body 116, which may be collectively referred to as a clamshell 118. The first body 114 includes a longitudinal wall 115 extending between a pair of ends 117. The longitudinal wall 115 may include an inner edge 126 and an outer edge 128, with the first body 114 including a plurality of attachment members/journals 130 extending from the inner edge 126. Each attachment member 130 may include an opening sized to receive a shaft, as will be explained in more detail below.

The second body 116 includes a longitudinal wall 119 extending between a pair of opposed ends 121. The longitudinal wall 119 may include an inner edge 132 and an outer edge 134, with the second body 116 including a plurality of attachment members/journals 136 extending from the inner edge 132. Each attachment member 136 may include an opening sized to receive a shaft, which may facilitate pivotal attachment of the first body 114 to the second body 116, as will be explained in more detail below.

According to one implementation, the first and second bodies 114, 116 may be pivotally connected to each other via shaft 123 to facilitate an articulation of the clamshell 118 between an ammunition capture/holding configuration and an ammunition release configuration. The shaft 123 extends through the attachment members 130, 136 and defines a pivot axis 138 about which the first body 114 may pivot relative to the second body 116. The use of only a single shaft 123 in the clamshell 118 may distinguish the second embodiment 118 from the first embodiment 18, which may include separate shafts 23, 25.

FIG. 2A shows a pair of clamshells 118 in an ammunition capture configuration represented by BB and a single clamshell 118 in the ammunition release configuration represented by AA. As the clamshell 118 transitions from the ammunition capture configuration toward the ammunition release position, the outer edges 128, 134 are moved away from each other. Conversely, as the clamshell 118 transitions from the ammunition release position toward the ammunition capture position, the outer edges 128, 134 are moved toward each other.

Figure 3C:
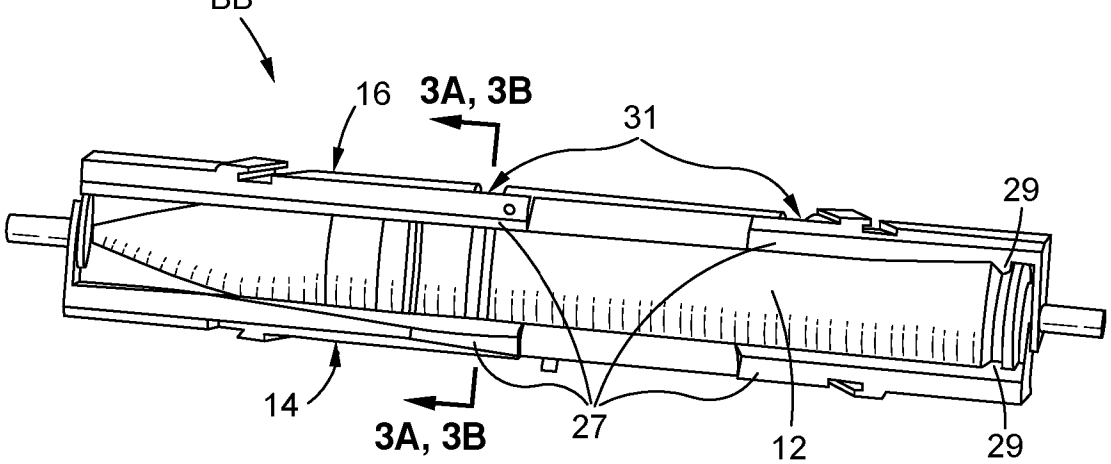
FIG. 3C is a perspective view of the first embodiment of the clamshell in the round captured configuration with the round of ammunition captured therein.
Figure 3B:
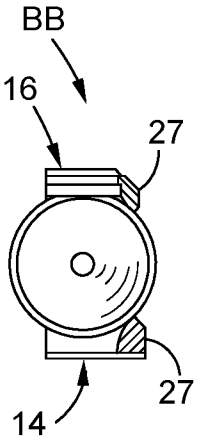
FIG. 3B is a sectioned end view of the first embodiment of the clamshell in the round captured configuration with the round of ammunition captured within the clamshell.
Figure 3A:
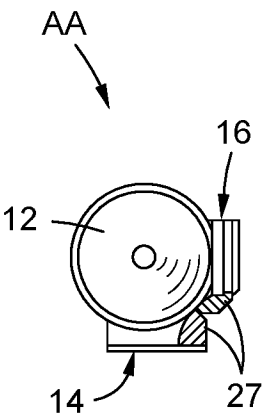
FIG. 3A is a sectioned end view of the first embodiment of the clamshell in the round release position with a round of ammunition placed within the clamshell.
Figure 4C:
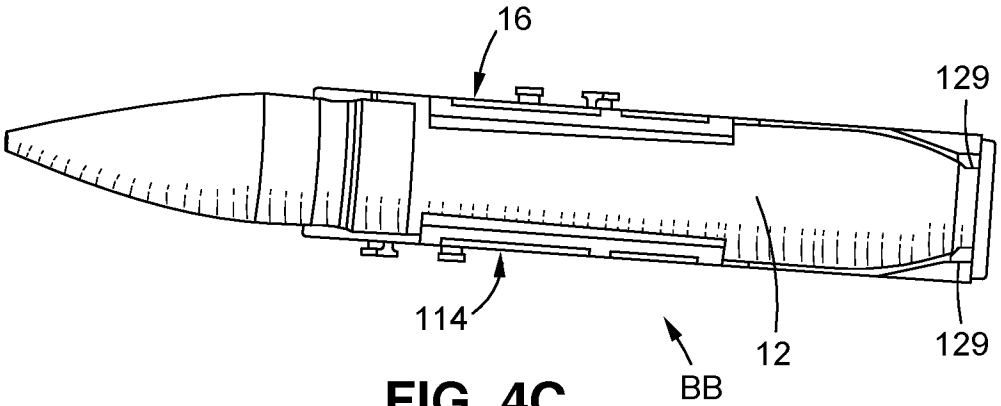
FIG. 4C is a perspective view of the second embodiment of the clamshell in the round captured configuration with the round of ammunition captured therein.
Figure 4B:
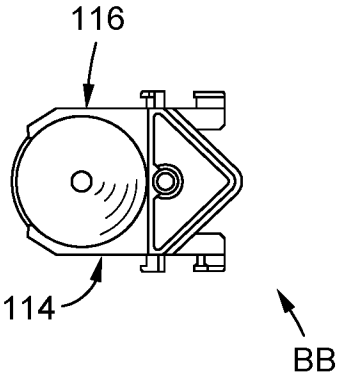
FIG. 4B is an end view of the second embodiment of the clamshell in the round captured configuration with the round of ammunition captured within the clamshell.
Figure 4A:
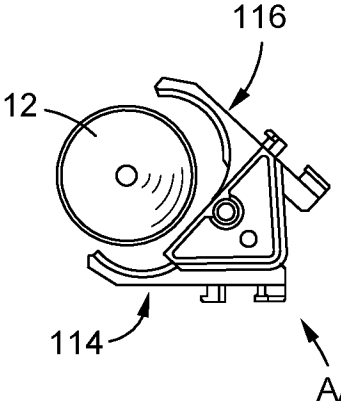
FIG. 4A is an end view of the second embodiment of the clamshell in the round release position with a round of ammunition placed within the clamshell.

While transporting the ammunition 12, the clamshell 18, 118 may completely capture and control the ammunition round 12. FIGS. 3A and 3B depict sectioned end views of a sequential engagement of a round of ammunition 12 being received between a clamshell 18 of the compact conveyor twister 10, while FIG. 3C depicts an upper perspective view of the round 12 captured between the clamshell 18, 118. FIGS. 4A and 4B depict an end view of a sequential engagement of a round of ammunition 12 being received between a clamshell 118 of the compact conveyor twister 110, while FIG. 4C depicts an upper perspective view of the round 12 captured between the clamshell 18, 118.

Each clamshell 18, 118 may be specifically configured and adapted to interface with the ammunition round 12. For instance, each clamshell 18, 118 may include a guiding surface for guiding the ammunition round 12 into engagement with the clamshell 18, 118. Furthermore, each clamshell 18, 118 may be configured to interface or engage with the ammunition round 12, such as interfacing with an extractor groove on the ammunition round 12, to retain the ammunition round 12 within the clamshell 18, 118. Along those lines, and referring now specifically to FIGS. 3A and 3B, each body 14, 16 may include a retaining rib 27 connected to a respective longitudinal wall 15, 19 that may engage with an outer surface of the round 12 and partially enclosure, thus capture the round 12. Each retaining rib 27 may extend longitudinally along the respective longitudinal wall 15, 19 substantially between the respective end walls 17, 21. Alternatively, the retaining ribs 27 may extend only partially between the respective end walls 17, 21. The retaining ribs 27 may be rounded to allow for enhance engagement and smooth travel over the round 12 as the clamshell 18 receives the round 12 and engages the round 12 when transitioning between the ammunition release position (AA) and the ammunition capture position (BB). As can be seen, when the clamshell 18 transitions from the ammunition release position (AA) toward the ammunition capture position (BB), the distance between the retaining ribs 27 increases. In this regard, the retaining ribs 27 may be in contact with each other when the clamshell 18 is in the ammunition release position (AA). However, when the clamshell 18 assumes the ammunition capture position (BB), the bodies 14, 16 are moved such that the distance between the retaining ribs 27 increases to a magnitude that may be less than an outer diameter of the round 12.

It is also contemplated that at least one, and preferably both, bodies 14, 16 may include a locking rib 29 that may be received within a circumferential extractor groove formed in the round 12. In one embodiment the locking rib 29 may protrude from the walls 15, 19, although the position of the locking rib 29 is not limited thereto. When the locking rib 29 is received within the circumferential extractor groove, axial movement of the round 12 (e.g., movement along a longitudinal axis defined by the round 12) may be restricted.

It is also contemplated the first and/or second bodies 14, 16 may include interlocking features, such as cutouts 31, which facilitate engagement with the ammunition round 12 to cams and/or extraction rotors needed to extract the round from the clamshell chain and move it to the gun or back to a storage magazine.

The first and second bodies 114, 116 of the second embodiment 110 may also include one or more structures aimed at retaining the ammunition round 12 within the clamshell 118. For instance, the first and/or second bodies 114, 116 may also include a locking rib 129 also configured to engage with a circumferential extractor groove, and cutouts 131 to facilitate engagement with an ammunition round 12 to cams and/or extraction rotors.

Figure 5:
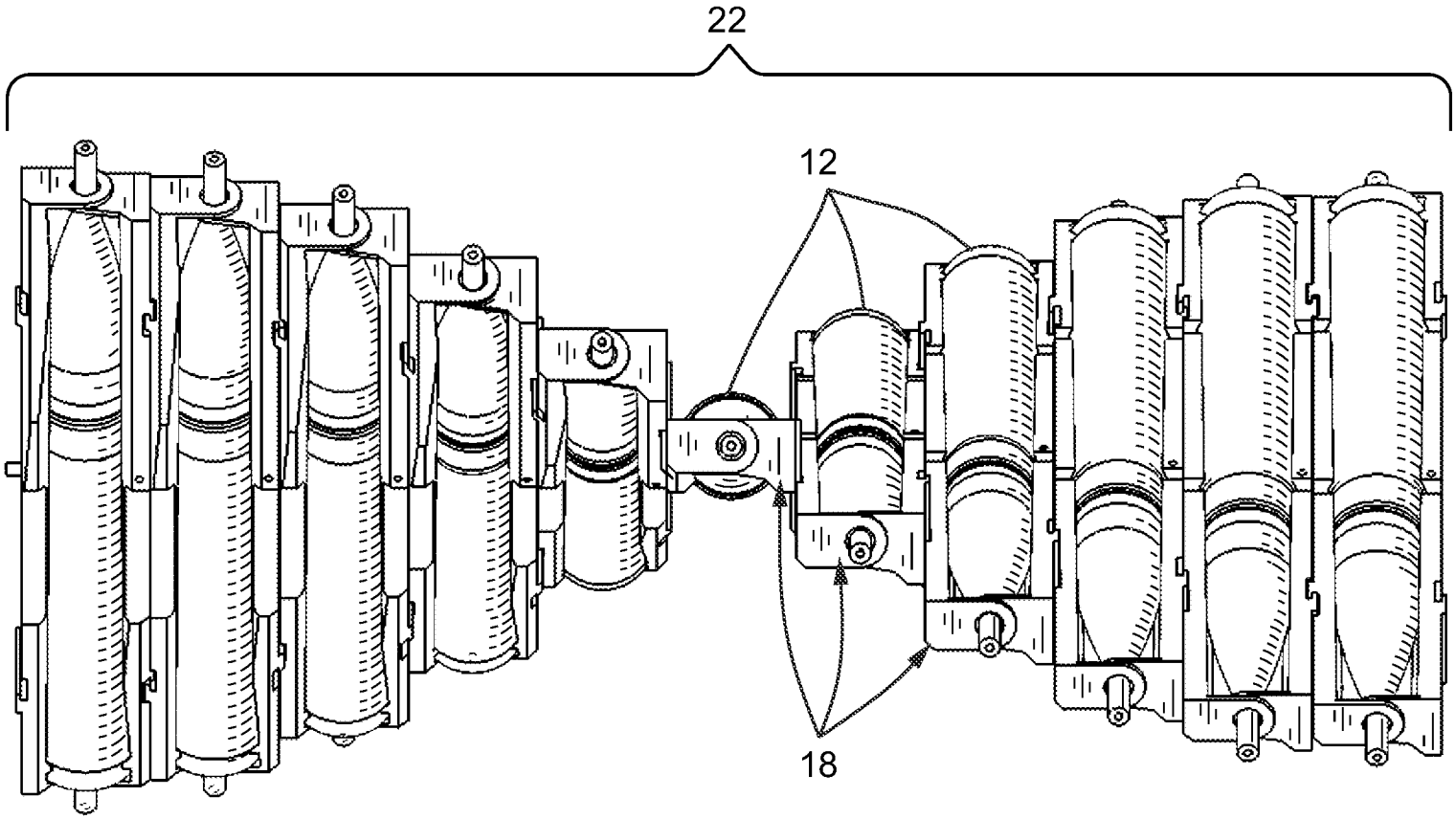
FIG. 5 is a front view of a string of the first embodiment of clamshells configured to allow for twisting action.
Figure 5A:
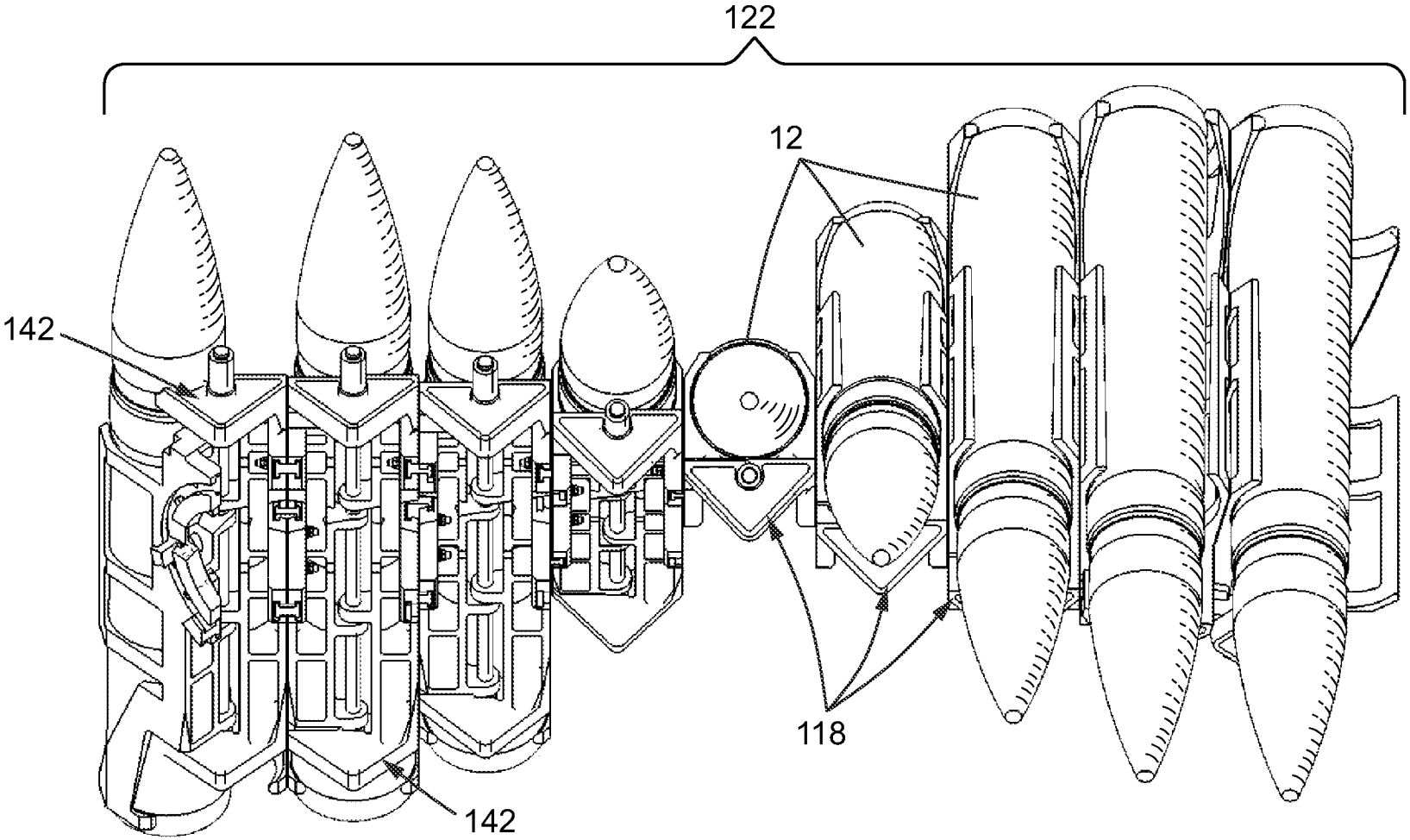
FIG. 5A is a front view of a string of the second embodiment of clamshells configured to allow for twisting action.

The clamshells 18, 118 within the mechanism 10, 110 may be affixed to each other like links in a chain in a manner that allows for a prescribed degree of pivot or twist with respect to one another about an axis of motion. This twisting action of multiple clamshells 18, 118 may allow a string/chain 22, 112 of clamshells 18, 118 to accommodate the needed gun elevation at one end of the clamshell chain 22, 122 while the other end of the clamshell string/chain 22, 122 remains intact with a stationary ammunition magazine as shown in FIGS. 5 and 5A.

Figure 6:
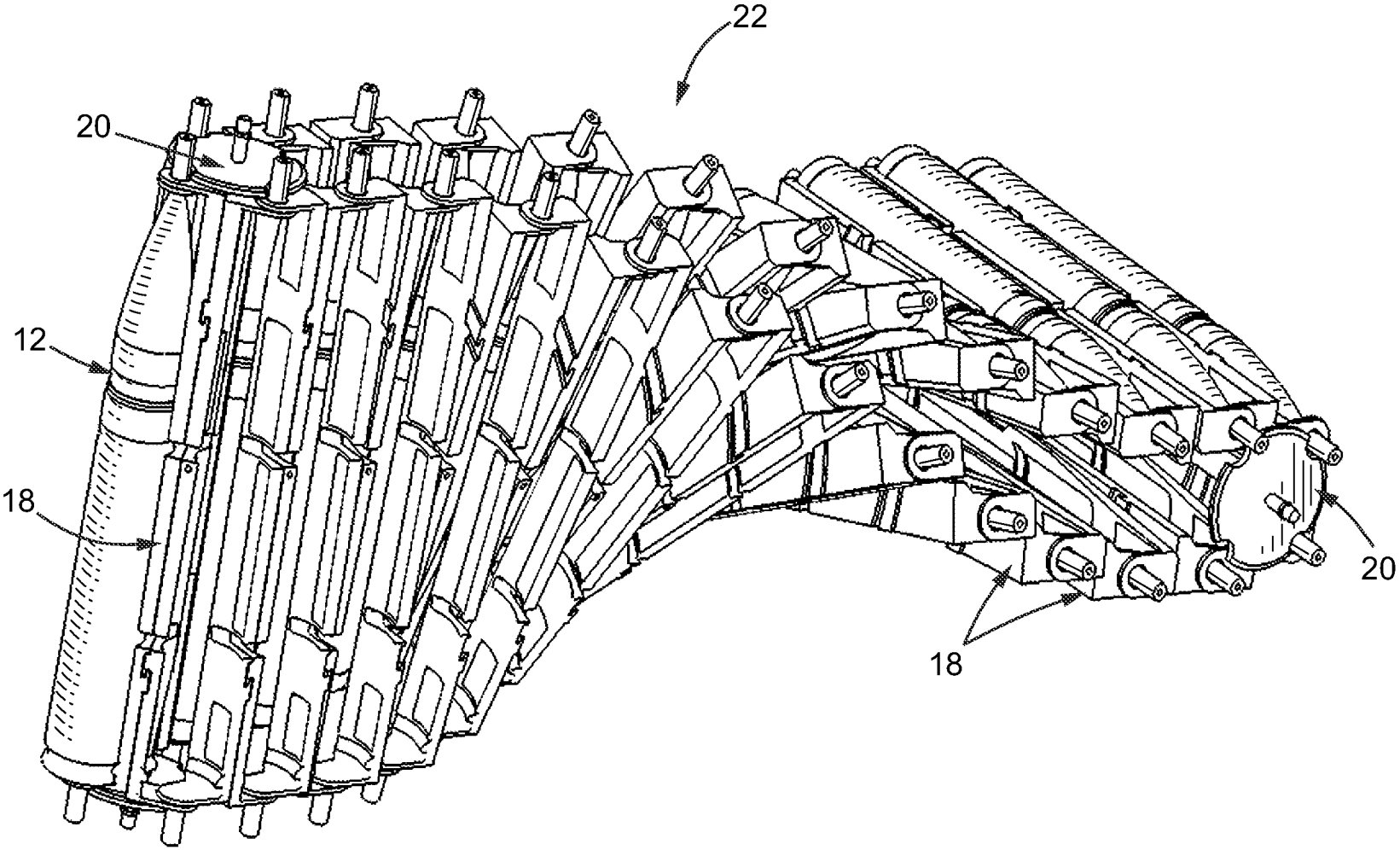
FIG. 6 is a perspective view of a plurality of interconnected clamshells of the first embodiment, arranged in a loop extending around a pair of rotors.
Figure 6A:
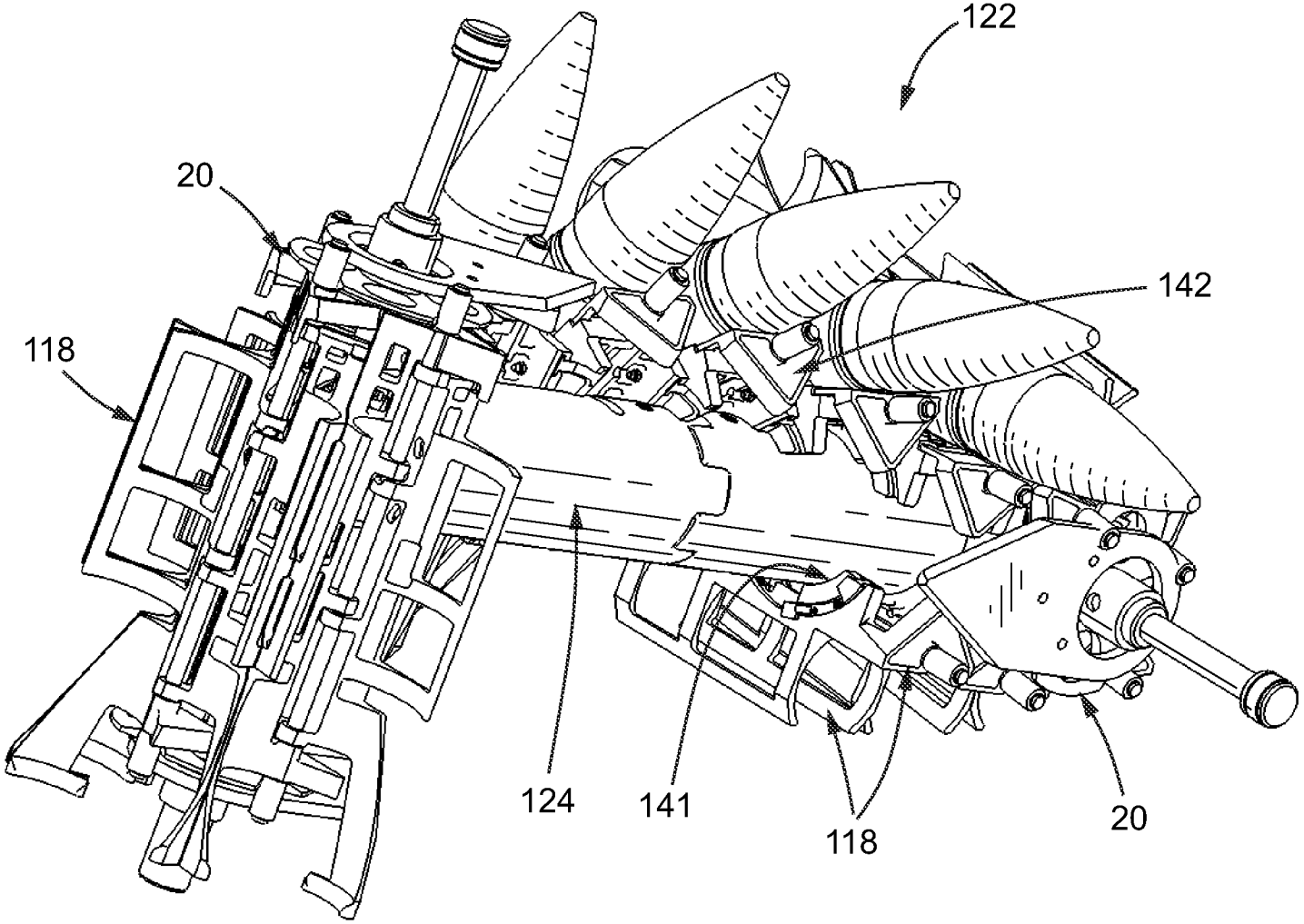
FIG. 6A is a perspective view of a plurality of interconnected clamshells of the second embodiment, arranged in a loop extending around a pair of rotors.

While a single chain 22, 122 of clamshells 18, 118 may carry ammunition 12 from the ammunition magazine to the gun, a return portion of the clamshell chain 22, 122, with or without spent cases, may run back from the gun to the ammunition magazine. The clamshell chain 22, 122 may thus form a continuous loop between the gun and the ammunition magazine. Examples of the chain 22, 122 forming a continuous loop are depicted in FIGS. 6 and 6A. At the gun, the clamshell chain 22, 122 may bend around a double set of sprockets known as a rotor 20 to form the return path. As the clamshells 18, 118 pass or bend around the rotor 20 one side of the clamshells 14, 16; 114, 116 separate or open up allowing the ammunition round 12 to be fed into the gun. FIGS. 6 and 6A are perspective views of a chain 22, 122 including a plurality of interconnected clamshells 18, 118 arranged in a loop extending around a pair of rotors 20. At the magazine end, the ammunition may be transferred from the clamshells 18, 118, in a similar way, to another method of storage within the ammunition magazine, or the clamshells 18, 118 themselves may enter the magazine and become an integral part of ammunition 12 being stored inside the ammunition magazine.

Figure 7:
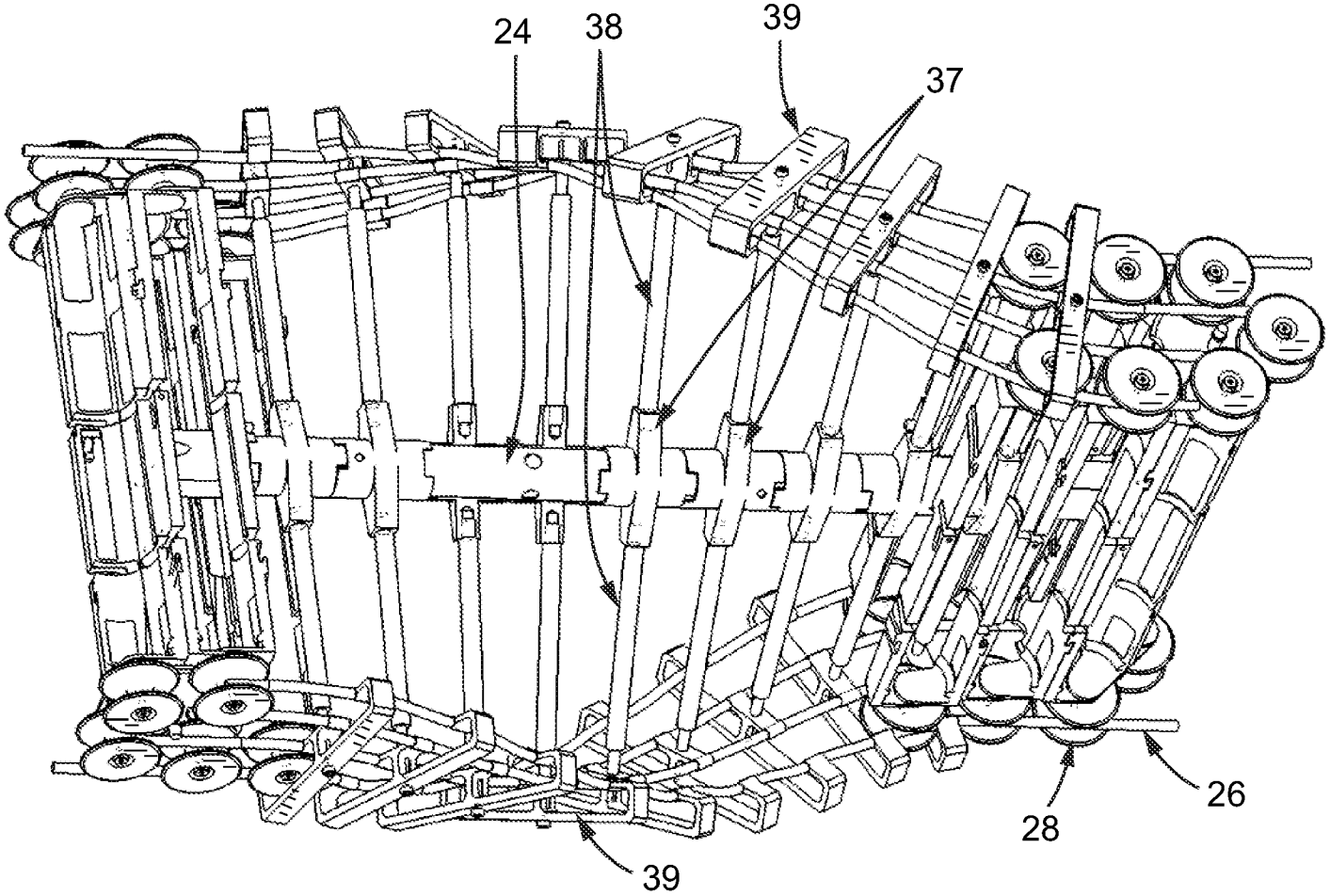
FIG. 7 is a perspective view depicting a central spine with ribs and guide wires that facilitate twisting of the clamshells via rollers.

Referring now specifically to FIG. 7, according to one embodiment, in order to support and guide the clamshell chain 22 between the magazine and gun there may be a structural center rod 24, which may act as a spine that runs in-between the two strings of clamshells 18. The center rod 24 may have rib like features (e.g., ribs 38) extending therefrom. These ribs 38 may provide structural assistance in guiding the clamshells 18 as they twist along the axis of the spine 24. The spine 24 may pass through, or include, vertebras 37 that are free to spin about the spine 24 or relative to an elongate spine axis. In one embodiment, the vertebrae 37 are moveable (e.g., rotatable and translatable) over an outer surface of the center rod 24. The vertebrae 37 may include features that prevents one vertebrae 37 from twisting too far relative to its adjacent vertebrae 37. Thus, the twisting of the two rotors 20 may create a smooth twisting of the complete set of vertebrates 37 along the length of the spine 24.

A pair of ribs 38 may extend from each vertebrae 37 in generally opposed relation to each other, and a guide 39 may be located at a distal end of each rib 38. The guides 39 may be free to articulate or pivot relative to the ribs 38. The guides 39 may include features that control the roller 28. In this regard, guide wires 26 may run or extend in the direction of the spine 24, and the guides 39 may be configured to maintain the separation distances between the guide wires 26, with the guide wires 26 being configured to freely pass through the guides 39. With the freedom of the vertebrates 37 to articulate or pivot about the spine 24, as well as the freedom of the guides 39 to articulate or pivot about the ribs 38, these wires 26 may form a straight path when the clamshells 18 do not twist. Alternatively, portions of the guide wires 26 may act as springs that may be curved or arcuate to guide or urge the clamshells 18 in a prescribed direction associated with twisting of the clamshells 18. Indeed, when the end rotors 20 are rotated relative to each other to accommodate gun elevation motion, the guide wires 26 may form helical shapes. These guide wires 26 may then force the clamshells 18 to twist as they move along the direction of the spine 24. According to one embodiment, the clamshells 18 interface with the guide wires 26 are through rollers 28. These rollers 28 may be attached to the clamshells 18 on the hinge axis as shown in FIG. 7. In particular, the rollers 28 may be engaged with respective shafts 23, 25 on the bodies 14, 16.

The extended guide structure may have the freedom to allow for the natural forming of helix by the guide wires 26 upon twisting of the clamshells 18 about a twist axis. In addition to be able to twist about the central axis, each wire guide 39 may be capable of rotating about its own axis to conform to the direction of the guide wires 26. The guide structure may allow for slippage of the guide wires 26 as the wires 26 change in length or configuration as they transition from straight to a helix about twisting about the central axis.

The clamshells 18 may be interconnected to each other and may interface with the spine 24 such that the elongate axis of the spine, e.g., the central axis, may be the same axis about which the clamshells 18 rotate as they move along the loop.

According to a second embodiment, and as shown in FIGS. 1A and 6A, a tube 124 may be used to separate the two rotors 20 instead of a spine 24. The tube 124 may include at least one joint that allows for twisting of one rotor 20 relative to the other. The tube 124 may also be configured to allow for shimming or adjusting its length to allow for proper tensioning of the clamshell loop. In this regard, the tube 124 may extend along a longitudinal axis, to define a length, with the length being selectively adjustable between a minimum length and a maximum length. The distance between the rotors 20 may increase as the tube 124 transitions between the minimum length and the maximum length, and conversely, the distance between the rotors 20 may decrease as the tube 124 transitions between the maximum length and the minimum length. The adjustment in the length of the tube 124 may facilitate desired tension adjustment of the clamshell chain. The tube 124 may be telescopically adjustable, or adjustable via other means known in the art, to facilitate transition between the minimum and maximum lengths. Once adjusted, the two rotors 20 may stay at the adjusted length without change during cycle of the clamshell loop. In this second embodiment, the inner facing walls 141 (see FIG. 8A) of the clamshells 118 may include a feature that cradles the central tube 124, thereby allowing the tube 124 to provide guidance and support. In this regard, the feature may be complementary in configuration to the outer surface of the central tube 124. The clamshell 118 may include a cam extension 142 that may engage a similar or complementary feature on the opposite side of the loop, should the clamshells 118 twist in a manner to contact each other. This cam feature may be configured to contact prior to the ammunition rounds or other clamshell features and the cams may be shaped to slide past each other without jamming. The inner facing walls 141 of the clamshells 18 may be configured to translate, as well as pivot along the outer surface of the tube 124 as the chain 122 is driven by the rotors 20.

Figure 8A:
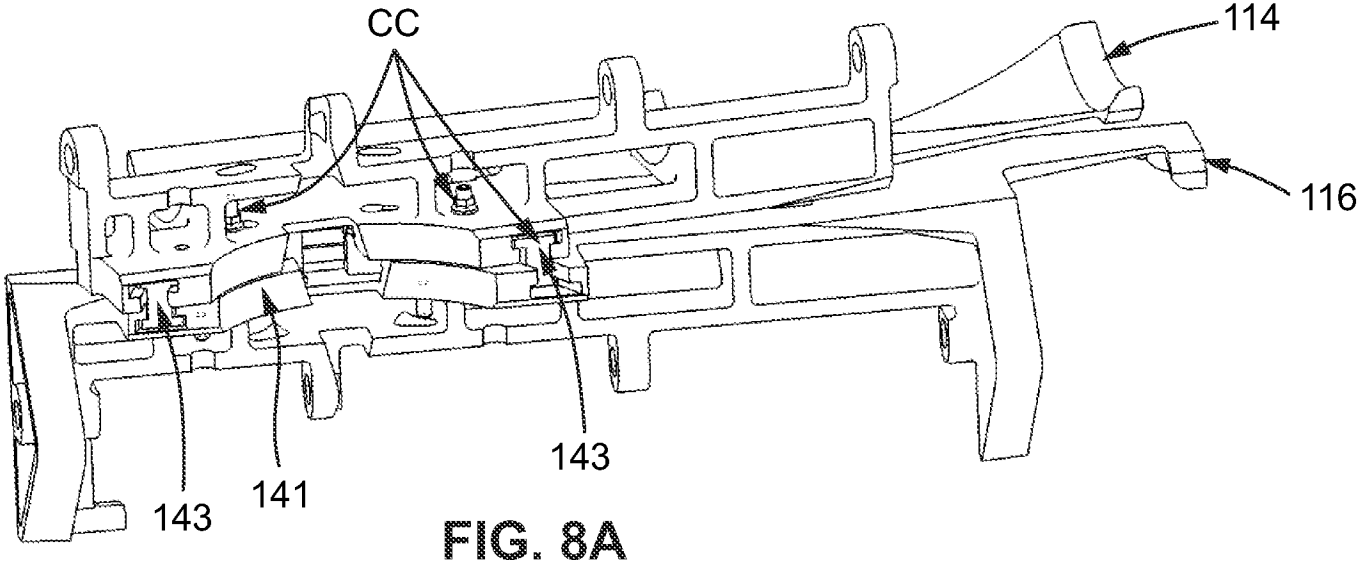
FIG. 8A is an upper perspective view of the second embodiment of clamshells.
Figure 8B:
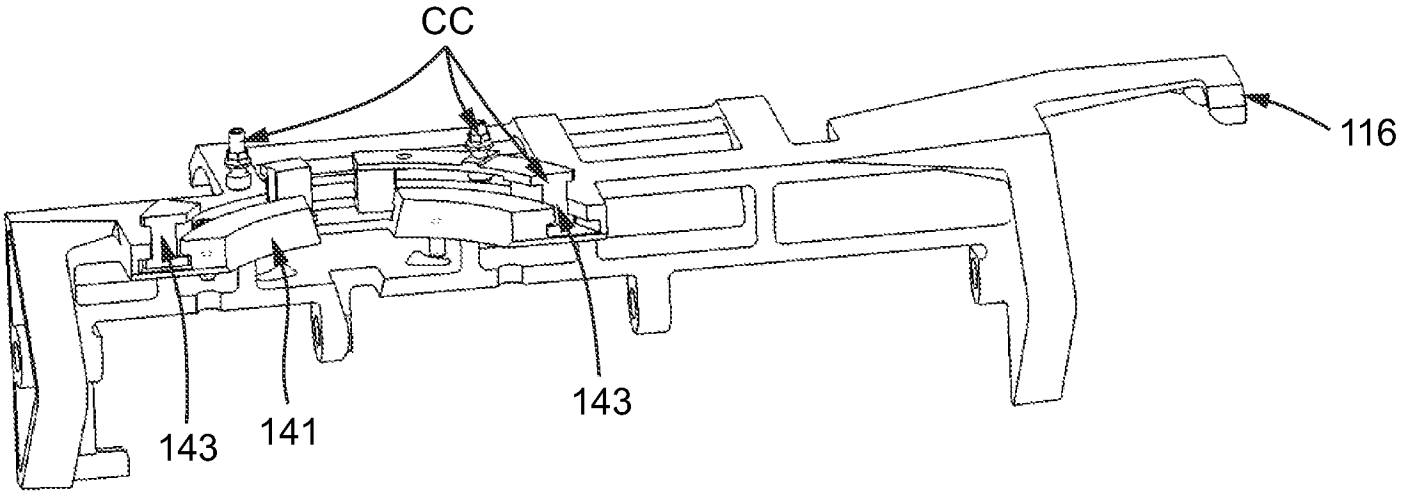
FIG. 8B is an upper perspective view of the second embodiment, with one of the clamshell bodies removed for purposes of clarity.

There may be features on the clamshells 18, 118 that allow one set of clamshells 18, 118 to pull or apply a force on the adjacent clamshell 18, 118 or set of clamshells 18, 118. Additionally, these features may allow one set of clamshells 18, 118 to twist in relation the adjacent set of clamshells 18, 118 without the two sets of clamshells 18, 118 coming apart. One such embodiment is depicted in FIGS. 8A and 8B, with curved grooves being formed in bodies 114, 116, which are positioned with each other to accommodate a linking body 143 to couple the bodies 114, 116 together. FIG. 8A shows the body 114 twisted relative to body 116. In FIG. 8B, body 114 is not shown for clarity to show the link 143 and the hardware represented by CC which are attached to body 114. The links provide the means for the clamshell bodies 114, 116 to twist axially relative to each other. Additionally, the links may also provide the features that limits axial twist between the two clamshell bodies 114, 116. Importantly, the axis of twist may not be centered on the clamshells 18, 118, but may be offset to a projected point at approximately the center of the spine 24 or tube 124. There may be stops to limit the twist of one clamshell 18, 118 with respect to the other and there may be springs that resist the twist of one clamshell 18, 118 with respect to another serving to spread the angle of twist evenly between clamshells 18, 118. Cutouts at proper locations on the clamshell 18, 118 may allow for ammunition 12 to be scooped out of the clamshell 18, 118 or properly guided into the clamshells 18, 118 as the clamshells 18, 118 are driven around rotors 20 on either ends of the clamshell strings 22, 122.

It is contemplated that the mechanism 10, 110 may additionally include an external tubular housing 23 which may enclose at least a portion of the chain 22 of clamshells 18, 118. The housing 23 may include one or more openings formed therein, which may reduce the overall weight thereof, and may also certain facilitate heat transfer functions.

The particulars shown herein are by way of example only for purposes of illustrative discussion, and are not presented in the cause of providing what is believed to be most useful and readily understood description of the principles and conceptual aspects of the various embodiments of the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. A conveyor mechanism for use with ammunition rounds, the conveyor mechanism comprising:

a plurality of clamshells pivotally interconnected to each other, each clamshell includes a first body and a second body pivotally connected to the first body, each clamshell being selectively transitional between an ammunition holding configuration and an ammunition release position, the second body pivoting relative to the first body to facilitate transition between the ammunition holding configuration and the ammunition release configuration, the first and second bodies being configured to cooperatively engage one of the ammunition rounds when the clamshell is in the ammunition holding configuration;

wherein the plurality of clamshells are interconnected to each other to define an enclosed loop, the conveyor mechanism further comprising a pair of rotors in spaced relation to each other, each rotor being coupled to the enclosed loop;

a central spine interconnected to the plurality of clamshells, the plurality of clamshells being configured to move over the central spine; and multiple ribs extending from the central spine and attached with flexible guide wires.

2. The conveyor mechanism recited in claim 1, wherein each of the first and second bodies includes a longitudinal wall having an inner edge and an outer edge, the first and second bodies being pivotally connected adjacent their respective inner edges, the clamshell being configured such that the outer edges move away from each other as the clamshell transitions from the ammunition holding configuration toward the ammunition release configuration.

3. The conveyor mechanism recited in claim 1, wherein each clamshell includes a shaft, the first and second bodies of the corresponding clamshell being pivotally connected via the shaft.

4. The conveyor mechanism recited in claim 3, wherein each of the first and second bodies includes at least one attachment journal configured to facilitate attachment to the shaft.

5. The conveyor mechanism recited in claim 3, wherein the shaft defines a pivot axis about which the first body pivots relative to the second body.

6. The conveyor mechanism recited in claim 1, wherein:

each of the first and second bodies includes a longitudinal wall and a pair of end walls; and an adjacent pair of the plurality of clamshells is pivotally connected to each other at an approximate midpoint between the pair of end walls in each of interconnected clamshells.

7. The conveyor mechanism recited in claim 1, wherein the pair of rotors is operatively connected to each other to define a fixed distance therebetween, with each rotor being moveable about a respective axis relative to the other one of the pair of rotors.

8. The conveyer mechanism recited in claim 1, wherein each clamshell and rotor is configured such that travel of each clamshell over one of the pair of rotors causes the clamshell to transition between the ammunition holding configuration and the ammunition release configuration.

9. The conveyor mechanism recited in claim 1, wherein each rib is independently moveable relative to the central spine.

10. The conveyor mechanism of claim 1, wherein the central spine includes at least one joint that allows twist of one rotor relative to the pair rotors.

11. The conveyor mechanism of claim 1 wherein the central spine is configured to be of adjustable length to facilitate for proper tensioning of the clamshell loop.

12. The conveyor mechanism recited in claim 1, wherein each clamshell is configured to capture an extractor groove in one of the ammunition rounds to facilitate engagement between the clamshell and the ammunition round.

13. A conveyor mechanism for use with ammunition rounds, the conveyor mechanism comprising:

a plurality of clamshells pivotally interconnected to each other, each clamshell includes a first body and a second body pivotally connected to the first body, each clamshell being selectively transitional between an ammunition holding configuration and an ammunition release position, the second body pivoting relative to the first body to facilitate transition between the ammunition holding configuration and the ammunition release configuration, the first and second bodies being configured to cooperatively engage one of the ammunition rounds when the clamshell is in the ammunition holding configuration;

a spine interconnected to the plurality of clamshells, the plurality of clamshells being configured to move over the spine;

wherein adjacent ones of the plurality of clamshells are pivotable relative to each other about an axis of twist not centered on the clamshells but offset to a projected point at approximately the center of the spine.

14. The conveyor mechanism recited in claim 13, wherein adjacent ones of the plurality of clamshells are configured to limit relative twist therebetween.

15. The conveyor mechanism recited in claim 13, further comprising extended guides having interlocking features that limit axial twist from one guide to the next.

16. A conveyor mechanism for use with ammunition rounds, the conveyor mechanism comprising:

a plurality of clamshells pivotally interconnected to each other, each clamshell includes a first body and a second body pivotally connected to the first body, each clamshell being selectively transitional between an ammunition holding configuration and an ammunition release position, the second body pivoting relative to the first body to facilitate transition between the ammunition holding configuration and the ammunition release configuration, the first and second bodies being configured to cooperatively engage one of the ammunition rounds when the clamshell is in the ammunition holding configuration; and further comprising an external tubular housing sized to receive the plurality of clamshells to provide structural support and also prevent foreign object from getting into the path of the moving conveyor.

* * * * *